US012617650B2

(12) United States Patent
Tanigawa et al.

(10) Patent No.: US 12,617,650 B2
(45) Date of Patent: May 5, 2026

(54) YARN PATH GUIDE MECHANISM AND TEXTILE MACHINE

(71) Applicants: Murata Machinery, Ltd., Kyoto (JP); Toyota Jidosha Kabushiki Kaisha, Toyota (JP)

(72) Inventors: Motohiro Tanigawa, Kyoto (JP); Masatsugu Goyude, Kyoto (JP); Toshihiro Matsui, Kyoto (JP); Hirotaka Wada, Kyoto (JP); Yoshihiro Kino, Kyoto (JP); Hidehiro Takeoka, Kyoto (JP); Yasuhiro Sakanashi, Kyoto (JP); Dai Shimizube, Kyoto (JP); Daigoro Nakamura, Kyoto (JP); Yoshinori Miura, Toyota (JP)

(73) Assignees: Murata Machinery, Ltd., Kyoto (JP); Toyota Jidosha Kabushiki Kaisha, Toyota (JP)

( * ) Notice: Subject to any disclaimer, the term of this patent is extended or adjusted under 35 U.S.C. 154(b) by 172 days.

(21) Appl. No.: 18/676,955

(22) Filed: May 29, 2024

(65) Prior Publication Data

US 2024/0400342 A1 Dec. 5, 2024

(30) Foreign Application Priority Data

May 30, 2023 (JP) ..... 2023-088635
May 20, 2024 (JP) ..... 2024-081666

(51) Int. Cl.
*B65H 31/00* (2006.01)
*B65H 54/553* (2006.01)
*B65H 63/04* (2006.01)

(52) U.S. Cl.
CPC ..... *B65H 63/04* (2013.01); *B65H 54/553* (2013.01); *B65H 2601/26* (2013.01); *B65H 2701/31* (2013.01)

(58) Field of Classification Search
CPC .... B65H 63/04; B65H 54/553; B65H 270/31; B65H 51/10; B65H 57/14
See application file for complete search history.

(56) References Cited

U.S. PATENT DOCUMENTS 3,355,983 A * 12/1967 Bogert ..... G03G 15/30 399/144
2012/0160897 A1* 6/2012 Enyedy ..... B65H 51/10 228/8
2021/0283825 A1 9/2021 Tatsushima et al.

FOREIGN PATENT DOCUMENTS

CN 109205389 A * 1/2019 ..... B65H 51/10
CN 110027205 A * 7/2019 ..... B29C 64/321
(Continued)

*Primary Examiner* — Emmanuel M Marcelo
(74) *Attorney, Agent, or Firm* — DLA Piper LLP (US)

(57) ABSTRACT

It is possible to suppress damage to a yarn path guide mechanism and a textile machine. There is a first supporter which makes contact with a supporting shaft supporting a roller, a second supporter which is capable of making contact with the supporting shaft, and a biasing member which biases the second supporter in a direction in which the supporting shaft is sandwiched between the second supporter and the first supporter. When a virtual straight line which passes through a winding center and a rotation center is a first virtual straight line whereas a virtual straight line which extends in a direction orthogonal to the first virtual straight line and passes through the rotation center is a second virtual straight line, the second supporter makes contact with a part of the supporting shaft, which is positionally opposite to the winding center over the second virtual straight line.

6 Claims, 9 Drawing Sheets

(56) References Cited

FOREIGN PATENT DOCUMENTS

| | | | | | |
|---|---|---|---|---|---|
| CN | 112357668 | A | * | 2/2021 | ..... B65H 51/10 |
| CN | 118970739 | A | * | 11/2024 | ..... H02G 1/06 |
| EP | 3031962 | B1 | | 10/2018 | |
| JP | 2021-142720 | | | 9/2021 | |
| KR | 20120056681 | A | * | 6/2012 | ..... B65H 57/14 |

* cited by examiner

YARN PATH GUIDE MECHANISM AND TEXTILE MACHINE

CROSS-REFERENCE TO RELATED APPLICATION

This application claims the benefit of Japanese Pat. App. No. 2023-088635, filed on May 30, 2023, which application is incorporated herein by reference in its entirety. This application claims the benefit of Japanese Pat. App. No. 2023-081666, filed on May 20, 2024, which application is incorporated herein by reference in its entirety.

BACKGROUND

This disclosure relates to a yarn path guide mechanism for guiding running fibers, and a textile machine including the yarn path guide mechanism.

In a textile machine, a yarn path guide mechanism is provided to guide running fibers. For example, Japanese Laid-Open Patent Publication No. 2021-142720 discloses a filament winding device that guides a fiber bundle supplied from a unwinding mechanism to a winding target by a winding head and winds the fiber bundle onto the winding target. In such a filament winding device, a guide roller (yarn path guide mechanism) configured to guide a running fiber bundle is provided between the unwinding mechanism and the winding head.

In the above-described textile machine, if the yarn supply is completely stopped or delayed on the upstream side in the running direction of the fibers of the yarn path guide mechanism due to poor unwinding of fibers or entanglement of the fibers, a large tension is generated in the fibers guided by the yarn path guide mechanism. As a result, a large force is applied to various mechanisms and components such as the yarn path guide mechanism in the textile machine, resulting in damage to the yarn path guide mechanism and the textile machine.

It could therefore be helpful to provide a yarn path guide mechanism with which damage to a yarn path guide mechanism and a textile machine can be suppressed, and a textile machine including the yarn path guide mechanism.

SUMMARY

We thus provide:

According to a first aspect, a yarn path guide mechanism which is capable of guiding running fiber includes: a roller which allows the fiber bundles to be wound onto the roller; a supporting shaft which supports the roller to be rotatable; a first supporter which makes contact with an outer circumferential surface of the supporting shaft at least on one side of the roller in an axial direction of the supporting shaft; a second supporter which is provided at a position where the supporting shaft is sandwiched between the second supporter and the first supporter and is able to make contact with the outer circumferential surface of the supporting shaft at least on the other side of the roller in the axial direction, the other side being opposite to the one side; and a biasing member which is configured to bias the second supporter in a direction in which the supporting shaft is sandwiched between the second supporter and the first supporter, the supporting shaft being supported in such a way that the supporting shaft is clamped between the first supporter and the second supporter, and when a virtual straight line which is orthogonal to the axial direction and passes through a winding center that is the center in a circumferential direction of the roller at a part where the fiber bundles are wound onto the roller and a rotation center of the supporting shaft is a first virtual straight line whereas the virtual straight line which extends in a direction orthogonal to both the axial direction and the first virtual straight line and passes through the rotation center is a second virtual straight line, the second supporter making contact with a part of the outer circumferential surface of the supporting shaft, which is positionally opposite to the winding center over the second virtual straight line.

According to this aspect, the roller receives a force exerted in direction from the winding center to the rotation center on the first virtual straight line, from the fiber bundles wound on the roller. The acted force increases as the tension generated in the fiber bundles increases. When a large tension is generated in the fiber bundles and the force acting on the roller becomes large, the second supporter moves in a direction against the biasing force of the biasing member. As a result, the support of the supporting shaft by the first supporter and the second supporter is canceled. Because the tension generated in the fiber bundles is lowered, damage to the yarn path guide mechanism and the textile machine in which the yarn path guide mechanism is provided can be suppressed.

According to a second aspect, the yarn path guide mechanism of the first aspect is arranged so that, in at least one of the first supporter or the second supporter, a notch is formed in a part opposing the outer circumference of the supporting shaft.

According to this aspect, at the portion of the first supporter and/or the second supporter where the notch is formed, the supporting shaft makes contact with the first supporter and/or the second supporter at plural parts, when viewed in the axial direction. The supporting shaft can therefore be stably supported compared to when a flat surface not having the notch makes contact with the supporting shaft and only one part of the first supporter and/or the second supporter makes contact with the supporting shaft when viewed in the axial direction.

According to a third aspect, the yarn path guide mechanism of the first or second aspect further includes: a base to which the first supporter and the second supporter are attached; and a connecting tool which directly or indirectly connects the supporting shaft with the base.

According to this aspect, even if a large tension is generated in the fiber bundles and the support of the supporting shaft by the first supporter and the second supporter is canceled, it is possible to prevent the supporting shaft from being moved afar from the base. Therefore, it is possible to prevent the loss of the supporting shaft. Furthermore, the task of resetting the supporting shaft on the first supporter and the second supporter becomes simplified.

According to a fourth aspect, a textile machine includes the yarn path guide mechanism of the first aspect.

According to this aspect, when a large tension is generated in guided fiber bundles, the yarn path guide mechanism decreases the tension generated in the fiber bundles. On this account, damage to the textile machine is suppressed.

According to a fifth aspect, the textile machine of the fourth aspect further includes: a sensor which is capable of detecting that support of the supporting shaft by the first supporter and the second supporter is canceled; a conveyance mechanism which is configured to convey the fiber bundles at a location at least downstream of the yarn path guide mechanism in a running direction of the fiber bundles; and a controller, the controller stopping conveyance of the fiber bundles by the conveyance mechanism, when the sensor detects that the support of the supporting shaft is canceled.

According to this aspect, when a large tension is generated in the fiber bundles and the support of the supporting shaft by the first supporter and the second supporter is canceled, the conveyance of the fiber bundles by the conveyance mechanism can be stopped. Due to this, it is possible to reliably suppress the damage to the textile machine caused by a large tension generated in the fiber bundles.

According to a sixth aspect, the textile machine of the fourth or fifth aspect further includes: a first guide member which is provided upstream of the yarn path guide mechanism in a running direction of the fiber bundles and is capable of guiding the running fiber bundles; and a second guide member which is provided downstream of the yarn path guide mechanism in the running direction of the fiber bundles and is capable of guiding the running fiber bundles, when the support of the supporting shaft by the first supporter and the second supporter is canceled, a yarn path between the first guide member and the second guide member being short compared to when the support shaft is supported by the first supporter and the second supporter.

According to this aspect, when the support of the supporting shaft by the first supporter and the second supporter is canceled, the yarn path between the first guide member and the second guide member is shortened, with the result that a tension generated in the fiber bundles is reliably decreased. Due to this, it is possible to reliably suppress the damage to the textile machine.

BRIEF DESCRIPTION OF THE DRAWINGS

FIG. 9(*b*) shows a state in which the support of the supporting shaft by the first supporting member and the second supporting member has been canceled.

DETAILED DESCRIPTION

Filament Winding Device

Figure 1:
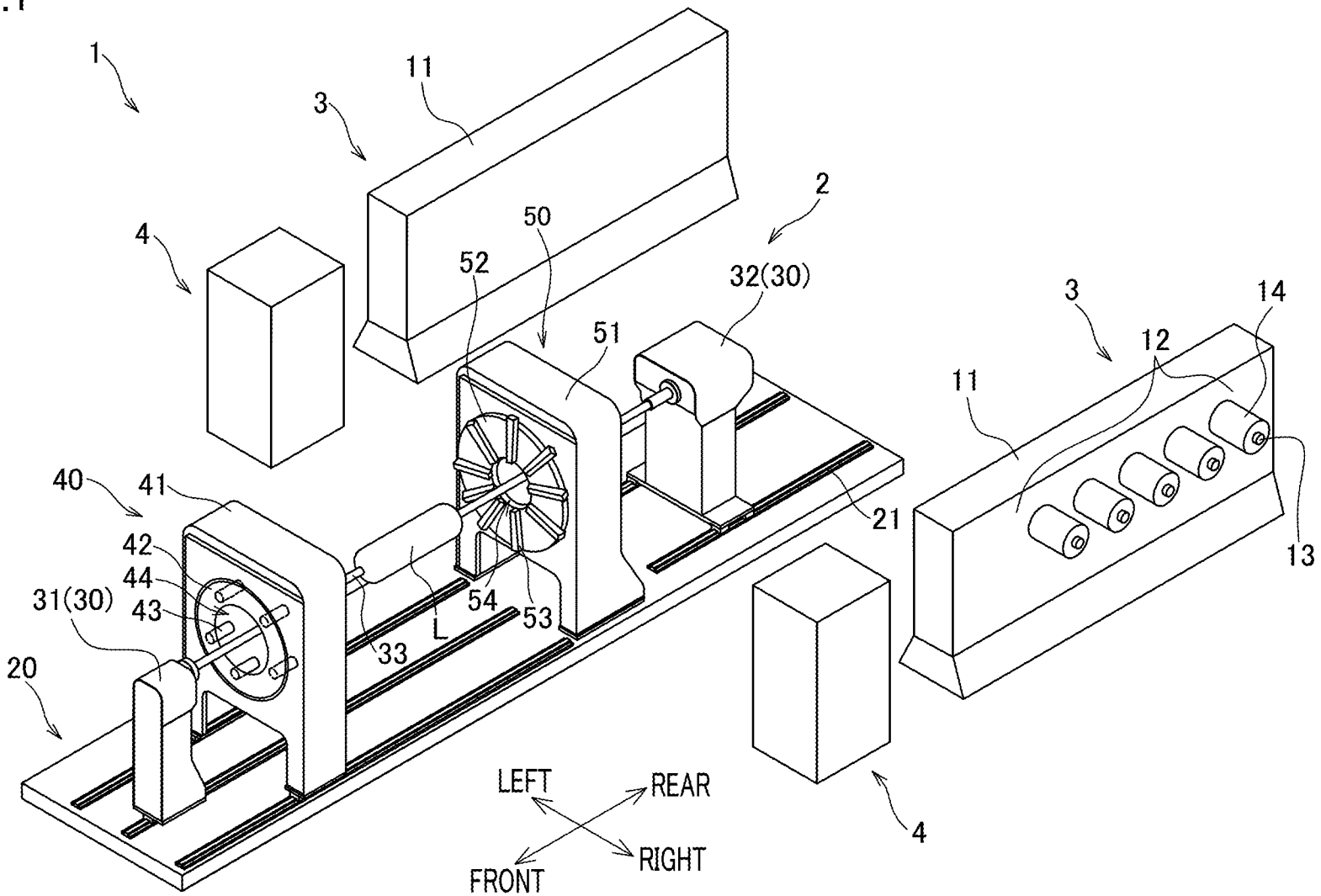
FIG. 1 is a perspective view showing a filament winding device related to an example of the yarn path guide mechanism and textile machine.
Figure 2:
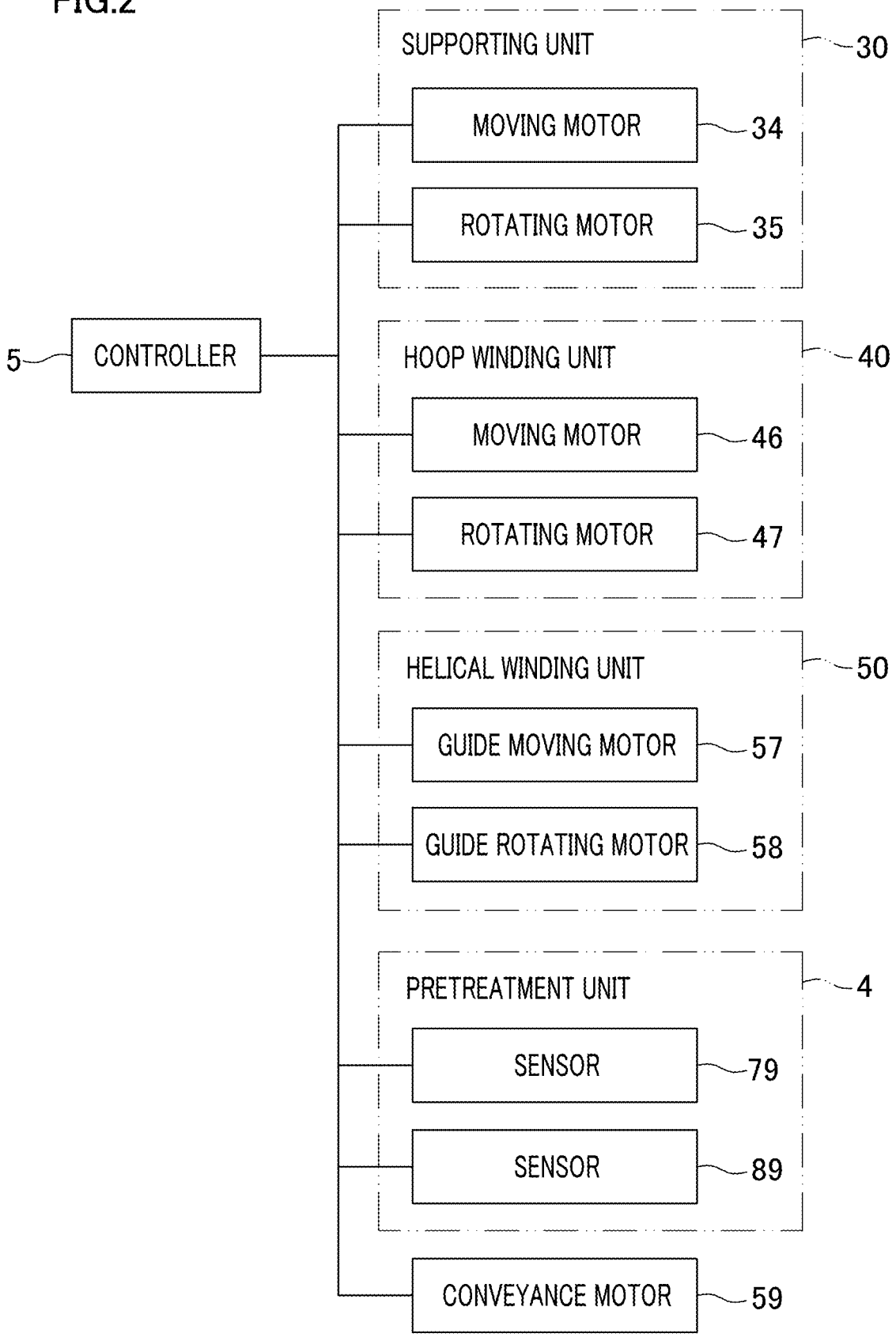
FIG. 2 is a block diagram showing an electrical structure of the filament winding device.

The following will describe an embodiment of the yarn path guide mechanism and textile machine. FIG. 1 is a perspective view showing a filament winding device 1 related to this example. FIG. 2 is a block diagram of an electric configuration of the filament winding device 1. For convenience of explanation, the directions (front-rear direction and left-right direction) shown in FIG. 1 are defined below. The front-rear direction and the left-right direction are directions parallel to the horizontal direction. The front-rear direction and the left-right direction are orthogonal to each other. Furthermore, the direction orthogonal to both the front-rear direction and the left-right direction is defined as an up-down direction. In this regard, the up-down direction is a vertical direction in which the gravity acts.

A filament winding device 1 is of a multiple-filaments feeding type, by which plural fiber bundles (not illustrated in FIG. 1) are simultaneously wound onto a liner L. The filament winding device 1 includes a winder 2, creel stands 3, and pretreatment units 4. On the whole, the filament winding device 1 is arranged to be substantially symmetrical in the left-right direction. The winder 2 winds fiber bundles onto a cylindrical liner L. Each fiber bundle is formed by, for example, impregnating a thermosetting or thermoplastic synthetic resin material into a fiber material such as carbon fiber. The shape of the liner L may vary depending on the final product. For example, when the final product is a pressure tank, the liner L having dome portions at both ends of a cylindrical portion as shown in FIG. 1 is used. The materials of the liner L include high-strength aluminum, metal, and resin. After the fiber bundles are wound onto the liner L, a thermosetting process such as baking or a cooling process is performed. As a result, a final product such as a high-strength pressure tank is produced.

The creel stands 3 are positioned on the both sides in the left-right direction of the winder 2, for example. The creel stands 3 are positioned, for example, in the vicinity of a rear end portion of the winder 2 in the front-rear direction. Each creel stand 3 has, for example, a substantially rectangular parallelepiped frame 11 that extends in the front-rear direction. The frame 11 is provided with, for example, one or more bobbin holder group 12. The bobbin holder group 12 is provided to correspond to each of nozzle units 53 of a later-described helical winding unit 50, for example. Each bobbin holder group 12 has a plurality of (five in the present embodiment) bobbin holders 13 aligned in, for example, the front-rear direction. Each bobbin holder 13 has an axis that extends in the left-right direction, for example. Each bobbin holder 13 supports a bobbin 14 on which a fiber bundle is wound, in a rotatable manner. In the present embodiment, for example, nine bobbin holder groups 12 are provided, and five bobbins 14 are attached to each bobbin holder group 12. (Therefore 45 bobbins 14 are provided in total.) From the five bobbins 14 belonging to each bobbin holder group 12, five fiber bundles are supplied together. The fiber bundles supplied from the creel stand 3 are wound onto the liner L by the helical winding unit 50. While FIG. 1 show two creel stands 3, the number of the creel stands 3 is not limited to this. In addition, to avoid complication of the drawing, only one of the plural bobbin holder groups 12 is shown in FIG. 1.

The pretreatment units 4 are configured to perform a predetermined pretreatment (e.g., application of a tension) for the fiber bundles. The pretreatment units 4 are, for example, provided between the corresponding creel stands 3 and the helical winding unit 50 (described later) in the running direction of the fiber bundles.

Winder

The following will describe a more specific arrangement of the winder 2. The winder 2 includes a base 20, supporting units 30 (a first supporting unit 31 and a second supporting unit 32), a hoop winding unit 40, and a helical winding unit 50.

The base 20 supports the supporting units 30, the hoop winding unit 40, and the helical winding unit 50. On the top surface of the base 20, rails 21 are provided to extend in the front-rear direction. The supporting units 30 and the hoop winding unit 40 are movable in the front-rear direction along the rails 21. On the other hand, the helical winding unit 50 is fixed in position relative to the base 20, for example. The first supporting unit 31, the hoop winding unit 40, the helical winding unit 50, and the second supporting unit 32 are provided in this order from the front side to the rear side.

The supporting units 30 include the first supporting unit 31 and the second supporting unit 32. The first supporting unit 31 is positioned forward of the hoop winding unit 40. The second supporting unit 32 is positioned rearward of the helical winding unit 50. Through a supporting shaft 33 which extends in the axial direction of the liner L (i.e., in the front-rear direction), the supporting units 30 support the liner L so that the liner L is rotatable about the shaft. The supporting units 30 include a moving motor 34 and a rotating motor 35 (see FIG. 2). The moving motor 34 moves the supporting units 30 (the first supporting unit 31 and the second supporting unit 32) in the front-rear direction along the rails 21. The rotating motor 35 rotates the supporting shaft 33 so that the liner L is rotated about the shaft. The operations of the moving motor 34 and the rotating motor 35 are controlled by a controller 5.

The hoop winding unit 40 is configured to perform hoop-winding onto the circumferential surface of the liner L. The hoop-winding is a way of winding the fiber bundles onto the liner L in a direction substantially orthogonal to the axial direction of the liner L. The hoop winding unit 40 includes, for example, a main body 41, a rotation member 42, and plural (five in the present embodiment) bobbin holders 43. The main body 41 is movable in the front-rear direction along the rails 21. The rotation member 42 is an annular member with a passing hole 44 formed to allow the liner L to pass through. The rotation member 42 is supported by the main body 41 to be rotatable about the axis of the liner L. The bobbin holders 43 are attached to the rotation member 42 at regular intervals in the circumferential direction. Each bobbin holder 43 has a rotation shaft extending in the front-rear direction and supports a bobbin (not illustrated) on which a fiber bundle is wound, in a rotatable manner.

The hoop winding unit 40 includes a moving motor 46 and a rotating motor 47 (see FIG. 2). The moving motor 46 moves the main body 41 in the front-rear direction along the rails 21. The rotating motor 47 rotates the rotation member 42 about the axis of the liner L. The operations of the moving motor 46 and the rotating motor 47 are controlled by the controller 5. When the hoop-winding is performed, the controller 5 rotates the rotation member 42 while causing the main body 41 to reciprocate along the rails 21. Because of this, the fiber bundles are taken out from the respective bobbins rotating around the liner L, and are simultaneously hoop-wound onto the circumferential surface of the liner L.

The helical winding unit 50 is configured to perform helical-winding onto the circumferential surface of the liner L. The helical winding is a way of winding the fiber bundles onto the liner L in a direction substantially parallel to the axial direction of the liner L. The helical winding unit 50 includes, for example, a main body 51, a frame member 52, and plural (nine in the present embodiment) nozzle units 53. The main body 51 is fixed to the base 20, for example. The frame member 52 is an annular member with a passing hole 54 formed to allow the liner L to pass through. The frame member 52 is supported by the main body 51. The nozzle units 53 are radially arranged around the axis of liner L. Each nozzle unit 53 is attached to the frame member 52.

Figure 3:
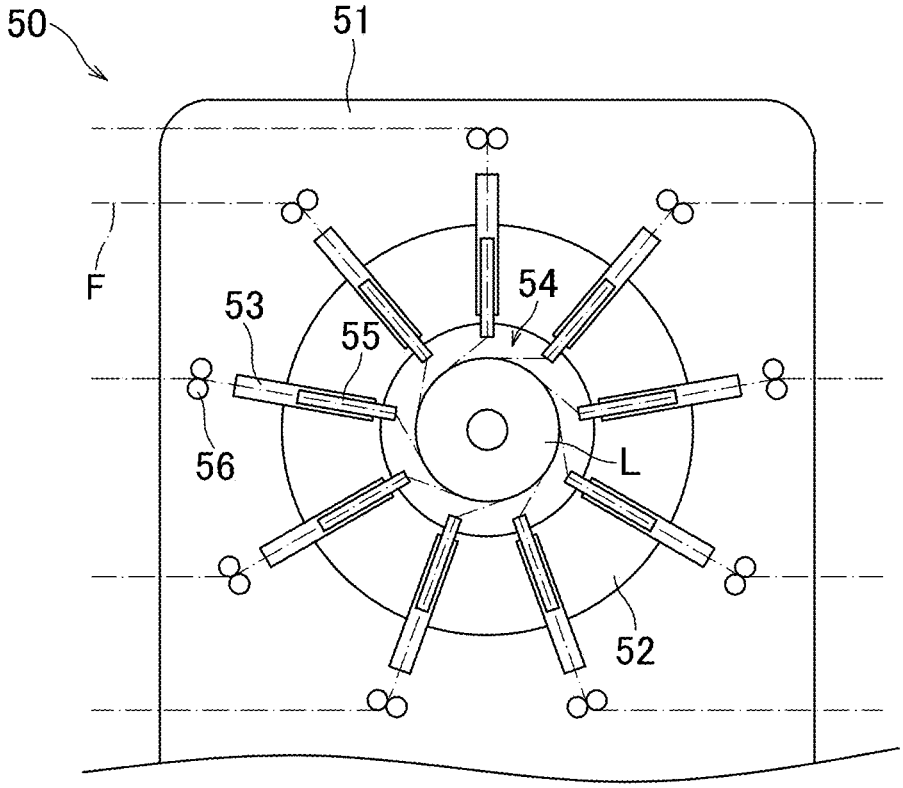
FIG. 3(*a*) and FIG. 3(*b*) are front elevations of a helical winding unit.
Figure 3:
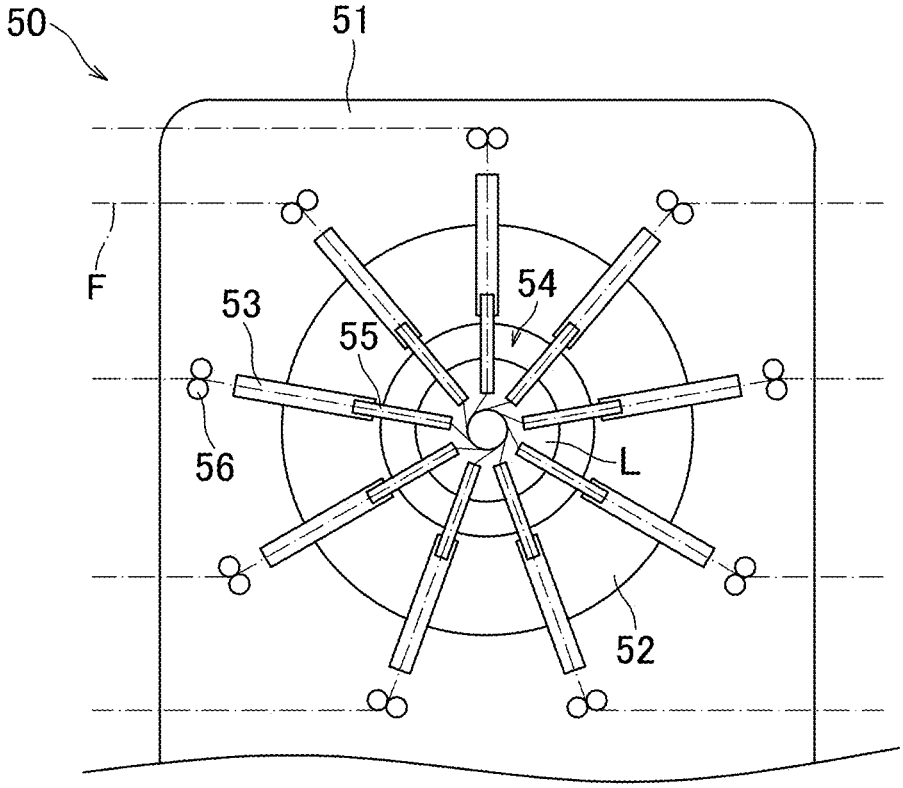

FIG. 3(*a*) and FIG. 3(*b*) are front elevations of the helical winding unit 50. To be more specific, FIG. 3(*a*) shows a situation when fiber bundles F are wound onto the cylindrical portion of the liner L. FIG. 3(*b*) shows a situation when fiber bundles F are wound onto the dome portion of the liner L. The nozzle unit 53 includes a guide member 55 guiding the fiber bundle F to the liner L. The guide member 55 extends in a radial direction of the liner L (hereinafter, this direction is simply referred to as the radial direction), and is configured to be movable in the radial direction and to be rotatable about a rotational axis extending in the radial direction. Radially outside each nozzle unit 53, a guide roller 56 is provided. The five fiber bundles F taken out from each bobbin holder group 12 of the creel stand 3 are introduced into one of the guide members 55 via the guide roller 56, and then supplied to the liner L from the leading end of the guide member 55.

The helical winding unit 50 includes a guide moving motor 57 and a guide rotating motor 58 (see FIG. 2). The guide moving motor 57 moves the guide members 55 simultaneously in the radial directions. The guide rotating motor 58 rotates the guide members 55 simultaneously about the rotational axis. The operations of the guide moving motor 57 and the guide rotating motor 58 are controlled by the controller 5. When the helical winding is performed, the controller 5 causes the liner L to pass through the passing hole 54 while slowly rotating the liner L about the axis. At the same time, the controller 5 suitably moves the guide member 55 of each nozzle unit 53 in the radial direction while rotating the guide member 55 of each nozzle unit 53 about the rotational axis. As a result, five fiber bundles F are properly pulled out from the leading end of the guide member 55 of each nozzle unit 53, and 45 fiber bundles F in total are simultaneously helical-wound onto the circumferential surface of the liner L.

Furthermore, the filament winding device 1 includes conveyance rollers (including conveyance rollers 63*a* to 63*c* shown in FIG. 4), and a conveyance motor 59 (see FIG. 2) that drives these conveyance rollers. The conveyance rollers perform conveyance in such a way that fiber bundles F pulled out from the bobbin holder group 12 of each creel stand 3 are sent from the helical winding unit 50 toward the liner L through the pretreatment unit 4. The operation of the conveyance motor 59 is controlled by a controller 5. The conveyance rollers may be driven by a single conveyance motor 59. Alternatively, plural conveyance motors 59 may be provided for driving plural conveyance rollers.

Pretreatment Unit

Figure 4:
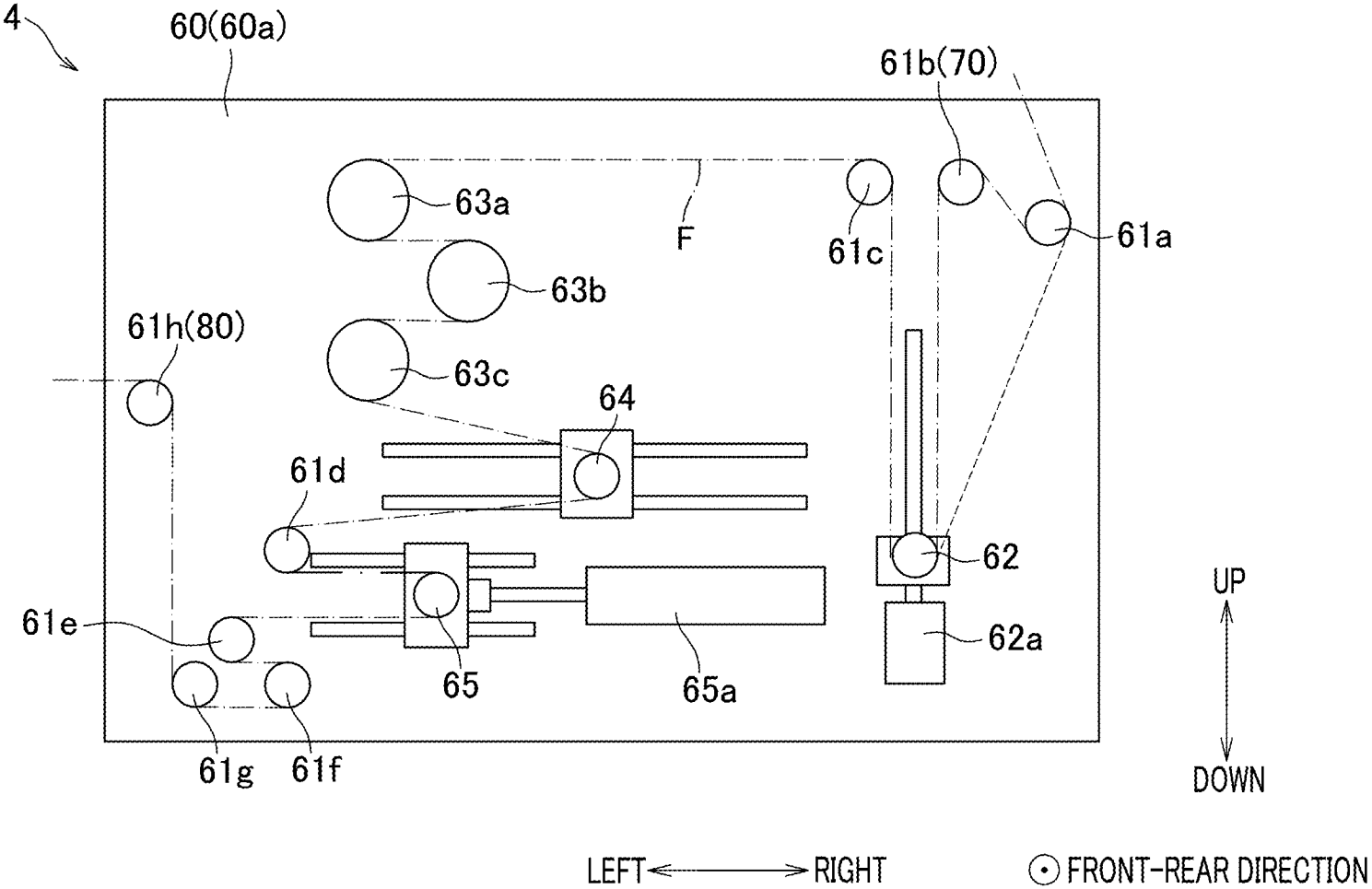
FIG. 4 shows a pretreatment unit that is viewed from the front side.

The following will describe a specific structure of the pretreatment unit 4 further with reference to FIG. 4. The pretreatment unit 4 is located forward of the corresponding creel stand 3. The pretreatment units 4 perform pretreatment such as tension application to the fiber bundles F supplied from the corresponding creel stand 3. The pretreatment unit 4 then supplies the pretreated fiber bundles F to the helical winding unit 50.

As shown in FIG. 4, main components of the pretreatment unit 4 are a base 60, guide rollers 61*a* to 61*h*, a dancer roller 62, conveyance rollers 63*a* to 63*c*, a dancer roller 64, and a tension roller 65. Each of these rollers is attached to a front side face 60*a* (surface substantially orthogonal to the front-rear direction) of the base 60. Each of the rollers is disposed so that its axial direction is in parallel to the front-rear direction. On each of the rollers, fiber bundles F supplied from the corresponding creel stand 3 are wound. From the upstream side in the running direction of the fiber bundles F, the above-described rollers are aligned in the following order: the guide rollers 61 and 61*b*, the dancer roller 62, the guide roller 61*c*, the conveyance rollers 63*a* to 63*c*, the dancer roller 64, the guide roller 61*d*, the tension roller 65, and the guide rollers 61*e* to 61*h*.

The guide rollers 61*a* to 61*h* are capable of guiding the running fiber bundles F. The guide roller 61*b* is part of a yarn path guide mechanism 70 which will be detailed later. The guide roller 61*h* is part of a yarn path guide mechanism 80.

The guide rollers 61*a* to 61*c* are provided at an upper end portion of the side face 60*a* of the base 60. The guide rollers 61*a*, 61*b*, and 61*c* are arranged in this order from right to left. The guide roller 61*b* and guide roller 61*c* are substantially identical in height. The guide roller 61*a* is positioned slightly below the guide rollers 61*b* and 61*c*.

The dancer roller 62 is positioned between the guide roller 61*b* and the guide roller 61*c* in the left-right direction. The dancer roller 62 is arranged to be movable in the up-down direction, at a position below the guide rollers 61*b* and 61*c*. The dancer roller 62 is loaded downward by a weight 62*a*. On this account, when the fiber bundles F loosen, the dancer roller 62 moves downward and removes the slack of the fiber bundles F.

The conveyance rollers 63*a* to 63*c* are positioned to the left of the guide roller 61*c*. From top to bottom, the conveyance rollers 63*a*, 63*b*, and 63*c* are aligned in this order. The conveyance roller 63*a* and conveyance roller 63*c* are substantially identical in position in the left-right direction. The conveyance roller 63*b* is located to the right of the conveyance rollers 63*a* and 63*c*. The conveying rollers 63*a* to 63*c* are rotate by the conveyance motor 59 (see FIG. 2) to impart a conveying force to the fiber bundles F.

The guide roller 61*d* is positioned below and slightly to the left of the conveyance roller 63*c*. The dancer roller 64 is positioned between the conveyance roller 63*c* and the guide roller 61*d* in the up-down direction. At a position to the right of the conveyance roller 63*c* and the guide roller 61*d*, the dancer roller 64 can be driven by a motor (not illustrated) to move along the left-right direction. As the dancer roller 64 moves in the left-right direction, variations in the running speed of the fiber bundles F are absorbed and the tension of the fiber bundles F is maintained to be constant.

The guide roller 61*e* is positioned below and to the left of the guide roller 61*d*. The tension roller 65 is positioned between the guide roller 61*d* and the guide roller 61*e* in the up-down direction. At a position to the right of the guide roller 61*d* and the guide roller 61*e*, the tension roller 65 can be driven by an air cylinder 65*a* to move along the left-right direction. As the tension roller 65 moves leftward and rightward, the tension of the fiber bundles F is adjusted.

The guide rollers 61*f* and 61*g* are positioned below the guide roller 61*e*. The guide roller 61*f* and guide roller 61*g* are substantially identical in height. The guide rollers 61*f* and 61*g* are provided at a lower end portion of the side face 60*a* of the base 60. The guide roller 61*f* is positioned to the right of the guide roller 61*e*. The guide roller 61*g* is positioned to the left of guide roller 61*e*. The guide roller 61*h* is positioned above the guide roller 61*g* and slightly to the left of the guide roller 61*g*. The guide roller 61*h* is positioned at a central part of the side face 60*a* of the base 60 in the up-down direction. The number and arrangement of each of the guide rollers 61*a* to 61*h*, the dancer roller 62, the conveyance rollers 63*a* to 63*c*, the dancer roller 64, and the tension roller 65 shown in FIG. 4 are not limited to the above.

The following will describe the structure of the yarn path guide mechanism 70 with reference to FIG. 5 to FIG. 9. The yarn path guide mechanism 70 includes the above-described guide roller 61*b*. The guide roller 61*b* is composed of a roller 71 on which the fiber bundles F can be wound and a supporting shaft 71*a* supporting the roller 71 to be rotatable. In addition to the above-described guide roller 61*b*, main components of the yarn path guide mechanism 70 are a pillar 72, a holding unit 73, a first supporting member 74, a second supporting member 75, and a biasing member 76.

The yarn path guide mechanism 70 supports the supporting shaft 71*a* by clamping the supporting shaft 71*a* from both sides of the roller 71 in the axial direction of the supporting shaft 71*a*, by first supporters 74*a* of the first supporting members 74 and second supporters 75*a* of the second supporting members 75. The pretreatment unit 4 includes a sensor 79 (see FIG. 2) which is capable of detecting that the support of the supporting shaft 71*a* by the first supporters 74*a* and the second supporters 75*a* is canceled. The sensor 79 is, e.g., a known optical sensor.

Figure 7:
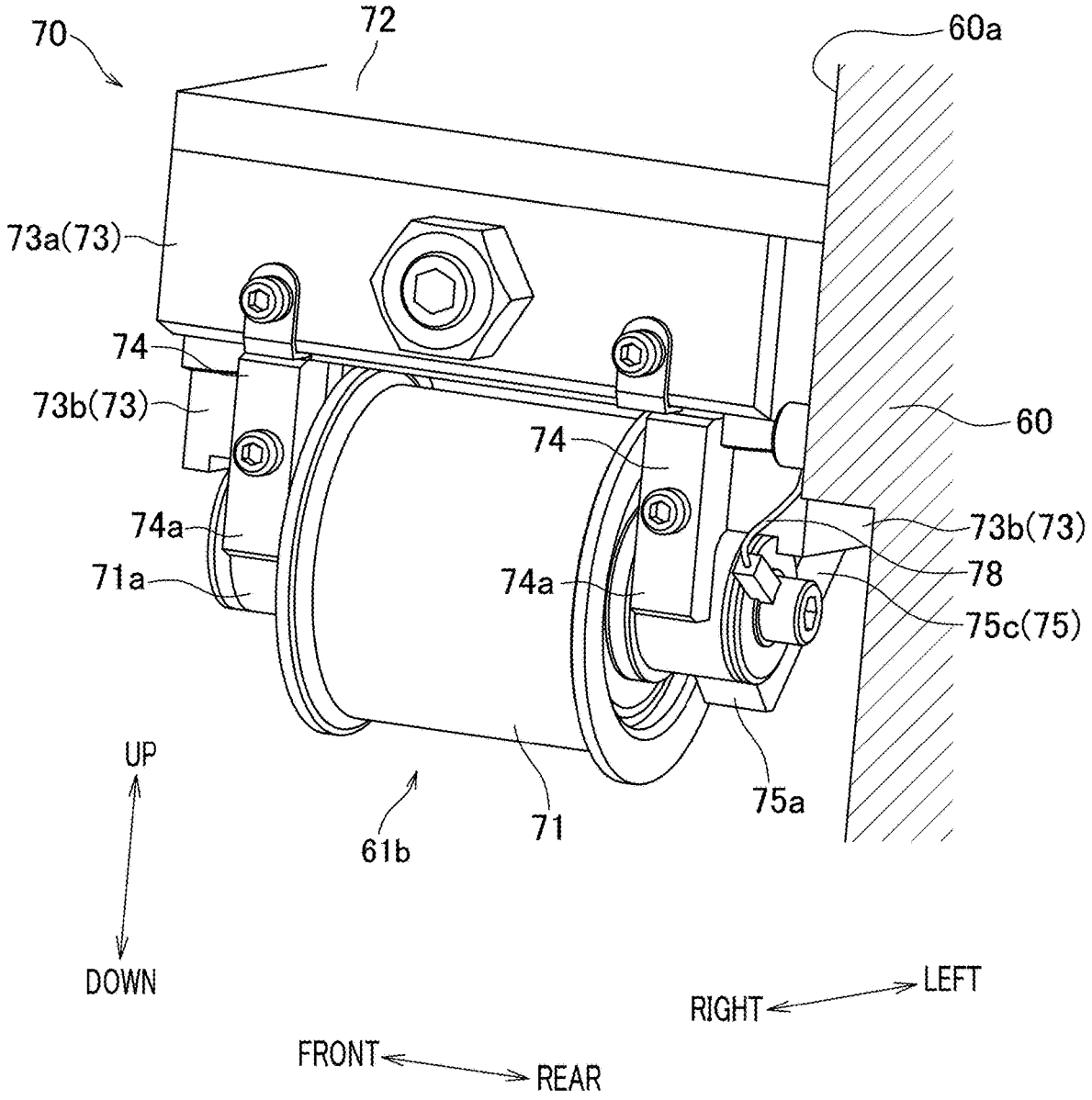
FIG. 7 is a perspective view of the yarn path guide mechanism viewed from the rear right.

The supporting shaft 71*a* is supported so that its axial direction is parallel to the front-rear direction. As shown in FIG. 7, to a rear end portion of the supporting shaft 71*a*, the other end portion of a connecting tool 78, whose one end portion has been attached to the base 60, is attached. In other words, the supporting shaft 71*a* is connected to the base 60 by the connecting tool 78.

Figure 8:
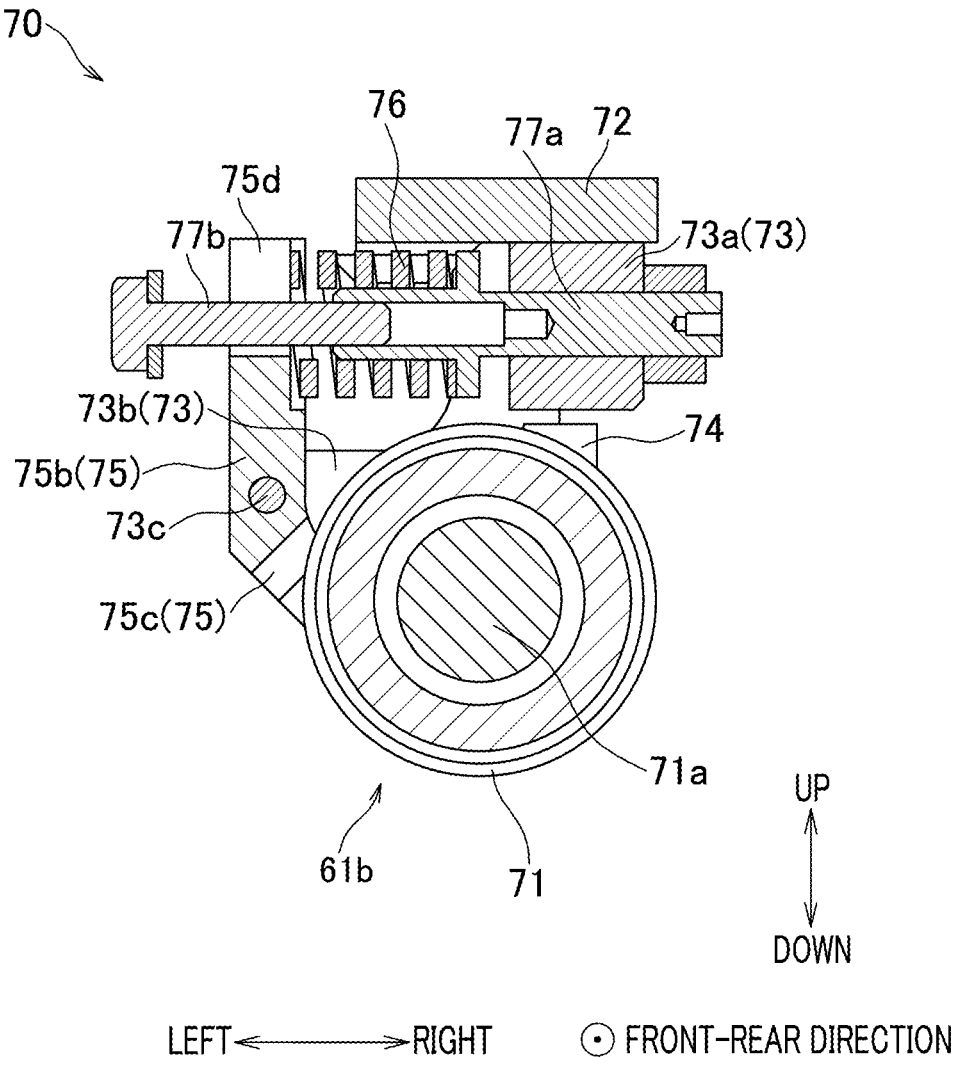
FIG. 8 is a cross section taken along a line VIII-VIII in FIG. 5.

The pillar 72 is attached to the side face 60*a* of the base 60. The pillar 72 extends along the front-rear direction. The holding unit 73 is attached to the bottom surface of the pillar 72. That is, the holding unit 73 has a base portion 73*a* that extends along the front-rear direction, and arm portions 73*b* provided at both end portions in the front-rear direction of the base portion 73*a*. The arm portion 73*b* extends leftward from the base portion 73*a*. As shown in FIG. 8, a nut 77*a* is attached to the base portion 73*a*. The nut 77*a* extends along the left-right direction. The nut 77*a* protrudes leftward as compared to the base portion 73*a*.

Figure 6:
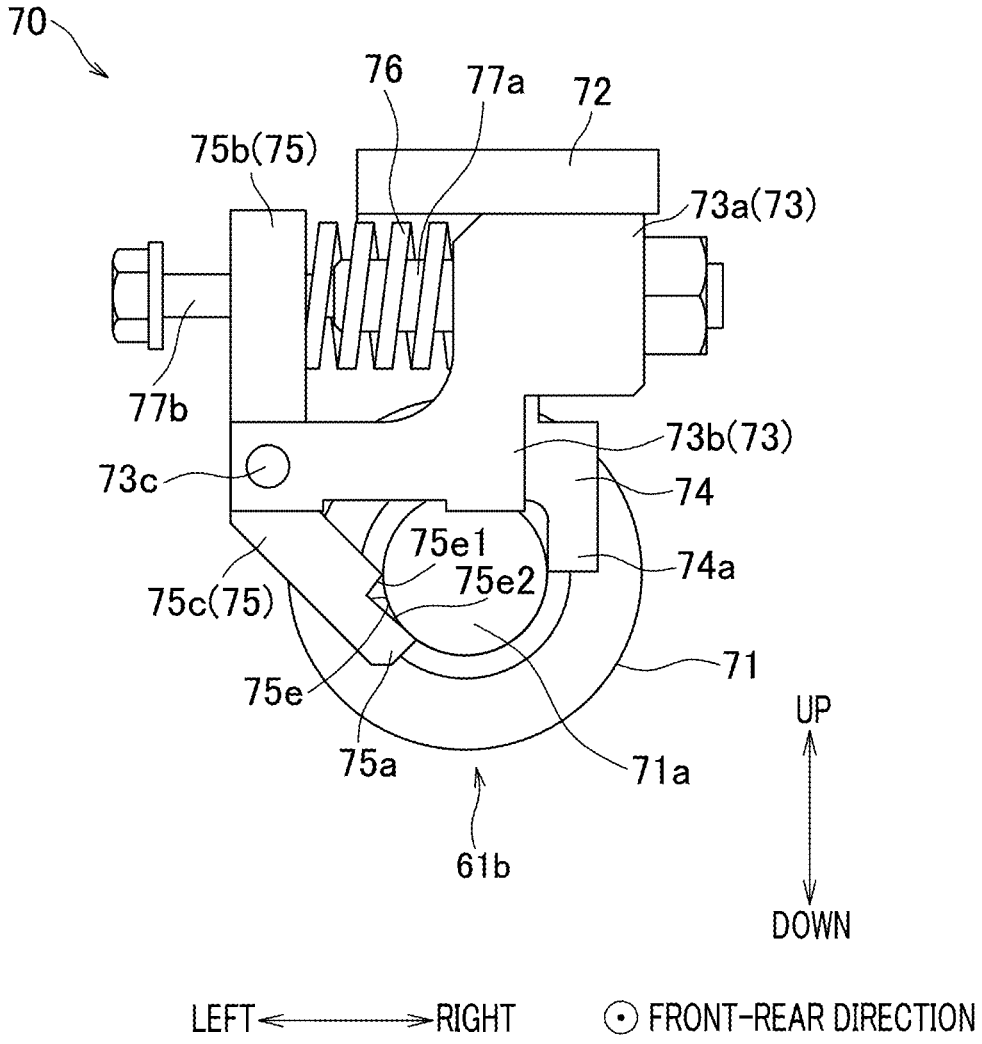
FIG. 6 shows a yarn path guide mechanism that is viewed from the front side.

As shown in FIG. 7, the first supporting member 74 is attached to each of the end portions in the front-rear direction of the base portion 73*a* of the holding unit 73. In other words, the first supporting member 74 is attached to the base 60 by the pillar 72 and the holding unit 73. The first supporting member 74 extends in the up-down direction when viewed in the front-rear direction, as shown in FIG. 6. The lower end portion of the first supporting member 74 is the first supporter 74*a*, and the supporting shaft 71*a* is clamped between the first supporter 74*a* and the second supporter 75*a* of the second supporting member 75. The first supporter 74*a* of each first supporting member 74 is able to make contact with the outer circumferential surface of the supporting shaft 71*a* on each side of the roller 71 in the front-rear direction (axial direction of the supporting shaft 71*a*).

Figure 5:
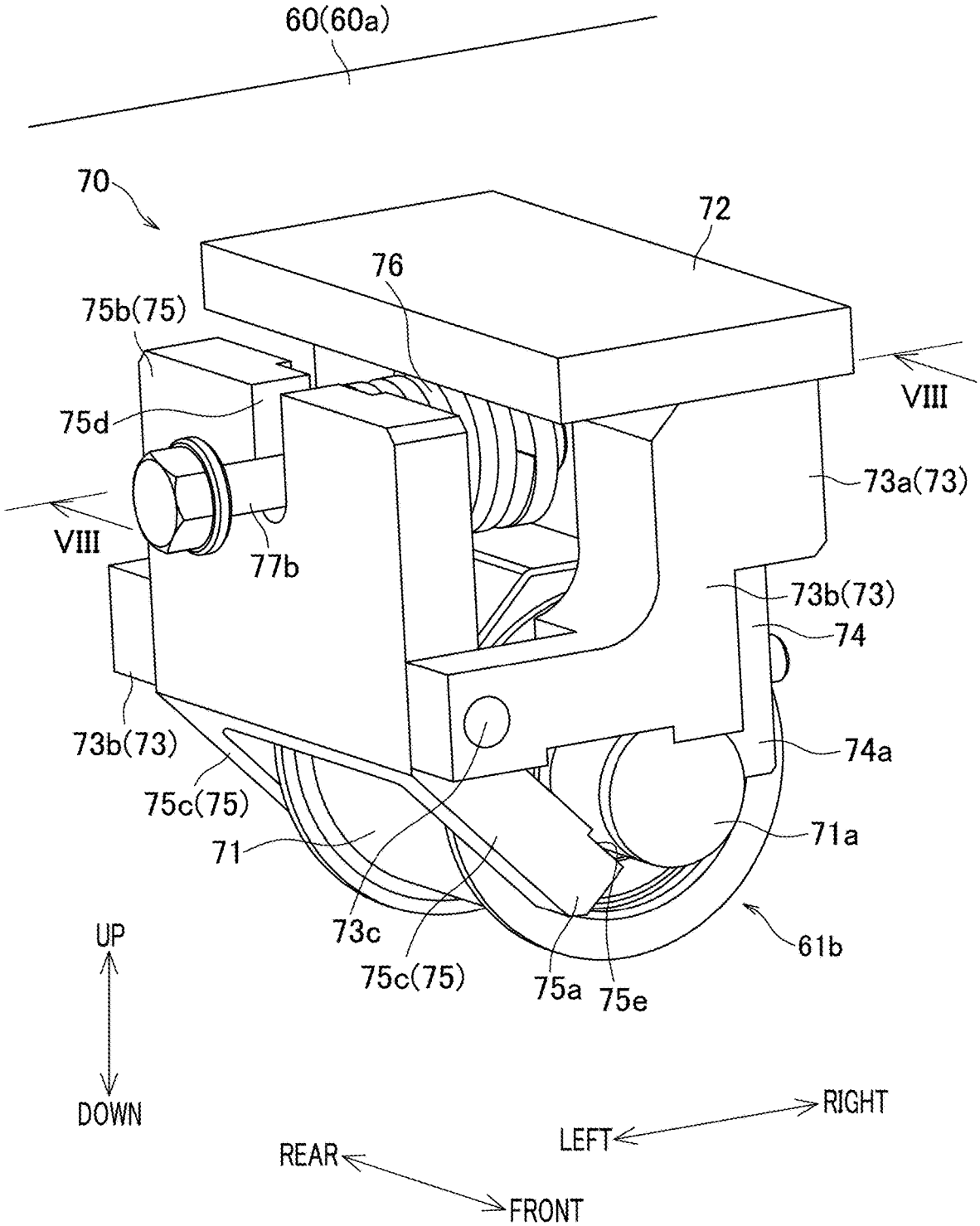
FIG. 5 is a perspective view of the yarn path guide mechanism viewed from the front left.

The second supporting member 75 is positioned to the left of the base portion 73*a* of the holding unit 73 and the first supporting member 74. As shown in FIG. 5, the second supporting member 75 includes an opposing portion 75*b* opposing the base portion 73*a* of the holding unit 73 and extending portions 75*c* respectively extending from end portions in the front-rear direction of a lower end portion of the opposing portion 75*b*. A leading end portion of each extension portion 75*c* is the second supporter 75*a*, and the supporting shaft 71*a* is clamped between the first supporter 74*a* of the first supporting member 74 and the second supporter 75*a*. To put it differently, the second supporter 75*a* is provided at a position where the supporting shaft 71*a* is clamped between the second supporter 75*a* and the first supporter 74*a*. The second supporter 75*a* of each extending portion 75*c* is able to make contact with the outer circumferential surface of the supporting shaft 71*a* on each side of the roller 71 in the front-rear direction (axial direction of the supporting shaft 71*a*).

Figure 9A:
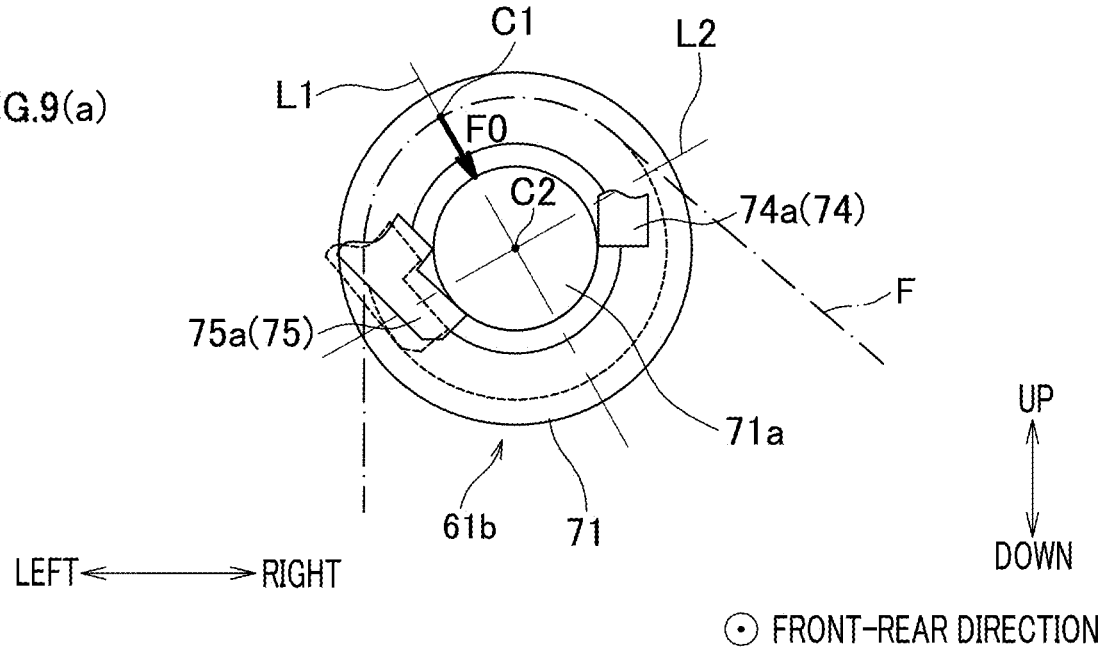
FIG. 9(*a*) shows a state in which a supporting shaft is supported by a first supporting member and a second supporting member.
Figure 9:
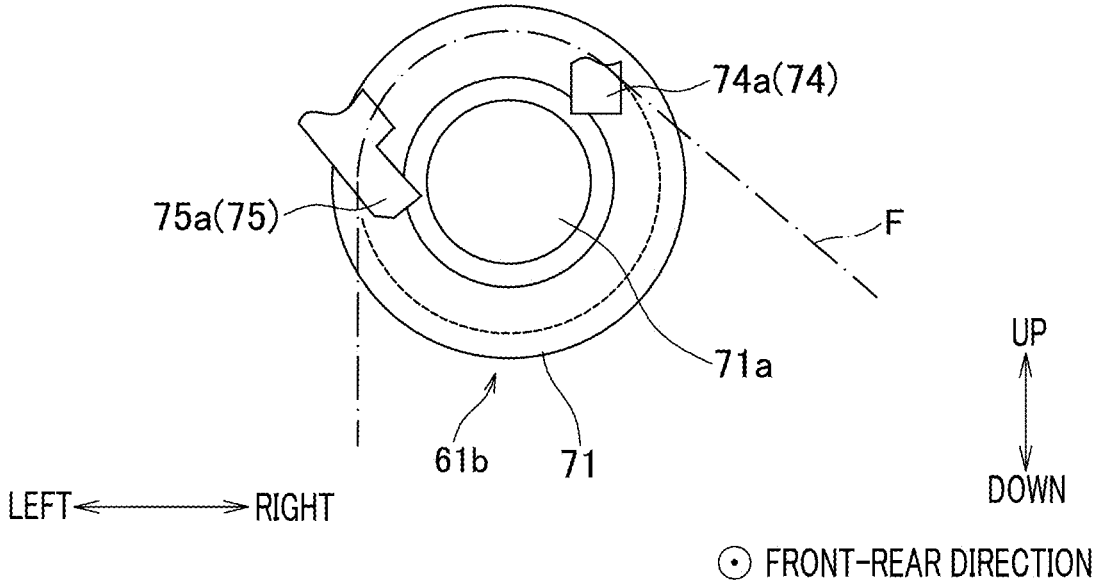

As shown in FIG. 9(*a*), the position of the center in the circumferential direction of the roller 71 at a portion of the roller 71 where the fiber bundles F are wound is referred to as a winding center C1. Furthermore, a virtual straight line which is orthogonal to the front-rear direction and passes through the winding center C1 and the rotation center C2 of the supporting shaft 71*a* is referred to as a first virtual straight line L1. Furthermore, a virtual straight line which extends in a direction orthogonal to both the front-rear direction and the first virtual straight line L1 and passes through the rotation center C2 of the supporting shaft 71*a* is referred to as a second virtual straight line L2. On the premise of these definitions, the second supporter 75*a* makes contact with a part of the outer circumferential surface of the supporting shaft 71*a*, which is opposite to the winding center C1 over the second virtual straight line L2.

As shown in FIG. 6, a notch 75*e* is formed in a portion of the second supporter 75*a*, which opposes the outer circumferential surface of the supporting shaft 71*a*. Because the notch 75*e* is formed in the second supporter 75*a*, the second supporter 75*a* has two flat surfaces 75*e*1 and 75*e*2 opposing the outer circumferential surface of the supporting shaft 71*a*. Lines perpendicular to the two flat surfaces 75*e*1 and 75*e*2 intersect with each other in a plane orthogonal to the front-rear direction. The second supporter 75*a* makes contact with the outer circumferential surface of the supporting shaft 71*a* at the two flat surfaces 75*e*1 and 75*e*2. In other words, the second supporter 75*a* makes contact with the outer circumferential surface of the supporting shaft 71*a* at two parts.

As shown in FIG. 5, the second supporting member 75 is arranged so that the lower end portion of the opposing portion 75*b* is provided between the paired arm portions 73*b* of the holding unit 73. The second supporting member 75 is supported to be swingable by a shaft 73*c* connecting the paired arm portions 73*b*. The shaft 73*c* extends in the front-rear direction. In other words, the second supporting member 75 is attached to the base 60 by the pillar 72 and the holding unit 73.

As shown in FIG. 6, when viewed in the front-rear direction, the opposing portion 75*b* and the extension portions 75*c* extend in different directions. That is, the second supporting member 75 is curved in shape when viewed in the front-rear direction. To be more specific, when the opposing portion 75*b* extends in the up-down direction, the extending portions 75*c* extend rightward and downward from the lower end portion of the opposing portion 75*b*.

As shown in FIG. 5 and FIG. 8, a notch 75*d* is formed in the opposing portion 75*b* of the second supporting member 75, into which a bolt 77*b* is inserted. The bolt 77*b* extends in the left-right direction. Between the base portion 73*a* of the holding unit 73 and the opposing portion 75*b* of the second supporting member 75, the bolt 77*b* is inserted into a nut 77*a* attached to the base portion 73*a* of the holding unit 73. With a junction between the nut 77*a* and the bolt 77*b*, a spring that is a biasing member 76 is fitted. The biasing member 76 may be, for example, an elastic member made of rubber. The biasing member 76 is disposed between the base portion 73*a* of the holding unit 73 and the opposing portion 75*b* of the second supporting member 75. The second supporting member 75 receives a biasing force in the counterclockwise direction about the shaft 73*c* from the biasing member 76, as shown in FIG. 6 and FIG. 8. In other words, the biasing member 76 biases the second supporter 75*a* in a direction in which the supporting shaft 71*a* is sandwiched between the second supporter 75*a* and the first supporter 74*a*.

The following will describe functions of the yarn path guide mechanism 70. As shown in FIG. 9(*a*), the roller 71 receives a force F0 exerted in direction from the winding center C1 to the rotation center C2 on the first virtual straight line L1, from the fiber bundle F wound on the roller 71. The force F0 increases as the tension of the fiber bundle F increases.

When a large tension is generated in the fiber bundles F and the force F0 acting on the roller 71 becomes equal to or larger than a predetermined value, the second supporting member 75 swings against the biasing force of the biasing member 76. At this time, the second supporter 75*a* of the second supporting member 75 moves away from the first supporter 74*a* of the first supporting member 74 as indicated by a dotted line in FIG. 9(*a*). As a result, as shown in FIG. 9(*b*), the support of the supporting shaft 71*a* by the first supporter 74*a* and the second supporter 75*a* is canceled.

In this way, in the yarn path guide mechanism 70, when a large tension is generated in the fiber bundles F, the guide roller 61*b* (the roller 71 and the supporting shaft 71*a*) is detached from the yarn path guide mechanism 70. The detached guide roller 61*b* (the roller 71 and the supporting shaft 71*a*) hangs down from the base 60 by the connecting tool 78.

When detecting by the sensor 79 that the support of the supporting shaft 71*a* by the first supporter 74*a* and the second supporter 75*a* is canceled, the controller 5 stops the conveyance motor 59 to stop the conveyance of the fiber bundles F. At this time, the controller 5 stops the conveyance of the fiber bundles F from the creel stand 3 to the helical winding unit 50.

In FIG. 4, the yarn path between the guide roller 61*a* and the dancer roller 62 that are provided upstream and downstream of the guide roller 61*b* in the running direction of the fiber bundle F is indicated by a dotted line, when the guide roller 61*b* is detached from the yarn path guide mechanism 70. The guide roller 61*a* is equivalent to the first guide member. The dancer roller 62 is equivalent to the second guide member. This yarn path is shorter than the yarn path between the guide roller 61*a* and the dancer roller 62 when the guide roller 61*b* is supported by the yarn path guide mechanism 70. In other words, the guide roller 61*b* is at a position where the yarn path becomes short after the guide roller 61*b* is detached from the yarn path guide mechanism 70. The difference in length of the yarn path between a case where the guide roller 61*b* is supported by the yarn path guide mechanism 70 and a case where the guide roller 61*b* is detached is longer than the length of the fiber bundles F conveyed during a period from the detachment of the guide roller 61*b* to the stop of the conveyance of the fiber bundle F. This makes it possible to suppress the generation of a large tension in the fiber bundles F, because the guide roller 61*b* is detached from the yarn path guide mechanism 70 when a tension with which the force F0 applied to the guide roller 61*b* (roller 71) is equal to or larger than a predetermined value is generated in the fiber bundles F.

The yarn path guide mechanism 80 has the same structure as the yarn path guide mechanism 70, and when a large tension is generated in the fiber bundles F, the guide roller 61*h* is detached. A specific configuration of the yarn path guide mechanism 80 is not described here. The pretreatment unit 4 includes a sensor 89 (see FIG. 2) which is capable of detecting that the support of the supporting shaft of the guide roller 61*h* is canceled. When detecting by the sensor 89 that the support of the supporting shaft of the guide roller 61*h* is canceled, the controller 5 stops the conveyance motor 59 to stop the conveyance of the fiber bundles F. Being similar to the guide roller 61*b*, the guide roller 61*h* is at a position where the yarn path is short after the detachment.

Characteristics of Embodiment

As described above, a yarn path guide mechanism 70 of the present embodiment includes: a roller 71 on which fiber bundles F can be wound; a supporting shaft 71*a* which supports the roller 71 to be rotatable; a first supporter 74*a* which makes contact with the outer circumferential surface of the supporting shaft 71*a* at each side of the roller 71 in the front-rear direction (axial direction of the supporting shaft 71*a*); a second supporter 75*a* which is positioned so that the supporting shaft 71*a* is sandwiched between the second supporter 75*a* and the first supporter 74*a* and which is able to make contact with the outer circumferential surface of the supporting shaft 71*a* on each side of the roller 71 in the front-rear direction; and a biasing member 76 which is configured to bias the second supporter 75*a* in a direction in which the supporting shaft 71*a* is sandwiched between the second supporter 75*a* and the first supporter 74*a*, the supporting shaft 71*a* being supported as the supporting shaft 71*a* is clamped between the first supporter 74*a* and the second supporter 75*a*. When a virtual straight line which is orthogonal to the front-rear direction and passes through a winding center C1 that is the center in the circumferential direction of the roller 71 at a part where the fiber bundle F is wound onto the roller 71 and the rotation center C2 of the supporting shaft 71*a* is a first virtual straight line L1 whereas a virtual straight line which extends in a direction orthogonal to both the front-rear direction and the first virtual straight line L1 and passes through the rotation center C2 is a second virtual straight line L2, the second supporter 75*a* makes contact with a part of the outer circumferential surface of the supporting shaft 71*a*, which is positionally opposite to the winding center C1 over the second virtual straight line L2.

With the above-described arrangement, the roller 71 receives a force F0 exerted in direction from the winding center C1 to the rotation center C2 on the first virtual straight line L1, from the fiber bundle F wound on the roller 71. The force F0 increases as the tension of the fiber bundle F increases. When a large tension is generated in the fiber bundles F and the force F0 acting on the roller 71 becomes equal to or larger than a predetermined value, the second supporter 75*a* moves in a direction against the biasing force of the biasing member 76. As a result, the support of the supporting shaft 71*a* by the first supporter 74*a* and the second supporter 75*a* is canceled. Therefore, it is possible to suppress damage to the yarn path guide mechanism 70, the pretreatment unit 4, and the helical winding unit 50.

In the yarn path guide mechanism 70 of the embodiment above, a notch 75*e* is formed in a portion of the second supporter 75*a*, which opposes the outer circumferential surface of the supporting shaft 71*a*. On this account, at the portion of the second supporter 75*a* where the notch 75*e* is formed, the supporting shaft 71*a* makes contact with the second supporter 75*a* at plural parts, when viewed in the front-rear direction. The supporting shaft 71*a* can therefore be stably supported as compared to a case where a flat surface not having the notch 75*e* makes contact with the supporting shaft 71*a* and only one part of the second supporter 75*a* makes contact with the supporting shaft 71*a* when viewed in the front-rear direction.

The yarn path guide mechanism 70 of the embodiment above further includes a base 60 to which the first supporter 74*a* and the second supporter 75*a* are attached and a connecting tool 78 which connects the supporting shaft 71*a* with the base 60. On this account, even if a large tension is generated in the fiber bundle F and the support of the supporting shaft 71*a* by the first supporter 74*a* and the second supporter 75*a* is canceled, it is possible to prevent the supporting shaft 71*a* from being moved afar from the base 60. Therefore, it is possible to prevent the loss of supporting shaft 71*a*. Furthermore, the task of resetting the supporting shaft 71*a* on the first supporter 74*a* and the second supporter 75*a* becomes simplified.

The filament winding device 1 of the embodiment above includes the yarn path guide mechanism 70, the sensor 79 capable of detecting that the support of the supporting shaft 71*a* by the first supporter 74*a* and the second supporter 75*a* is canceled, the conveyance motor 59 for driving the conveyance rollers including the conveyance rollers 63*a* to 63*c*, and the controller 5. When detecting by the sensor 79 that the support of the supporting shaft 71*a* is canceled, the controller 5 stops the conveyance motor 59 to stop the conveyance of the fiber bundle F. Therefore, when a large tension is generated in the fiber bundle F and the support of the supporting shaft 71*a* by the first supporter 74*a* and the second supporter 75*a* is canceled, the conveyance of the fiber bundle F can be stopped. Therefore, it is possible to reliably suppress the damage to various mechanisms and components provided in the filament winding device 1, which is caused by the large tension generated in the fiber bundle F.

In addition, in the filament winding device 1 of the embodiment above, when the guide roller 61*b* is detached from the yarn path guide mechanism 70, the yarn path between the guide roller 61*a* and the dancer roller 62 that are provided upstream downstream the guide roller 61*b* in the running direction of the fiber bundle F is short as compared to a case where the guide roller 61*b* is supported by the yarn path guide mechanism 70. Therefore, the tension generated in the fiber bundle F is reliably suppressed when the guide roller 61*b* is detached from the yarn path guide mechanism 70. Due to this, it is possible to reliably suppress the damage to various mechanisms and components provided in the filament winding device 1.

The embodiment is described hereinabove. However, the specific structure shall not be interpreted as to be limited to the above described embodiment. The scope is defined not by the above embodiment but by claims set forth below, and shall encompass the equivalents in the meaning of the claims and every modification within the scope of the claims.

While in the embodiment above the first supporting member 74 having the first supporter 74*a* is attached to each of the both end portions in the front-rear direction of the base portion 73*a* of the holding unit 73, the disclosure is not limited to this arrangement. That is to say, for example, two first supporting members 74 may be integrally formed with the holding unit 73.

While in the embodiment above two second supporters 75*a* are provided in one second supporting member 75, the disclosure is not limited to this arrangement. For example, one second supporter 75*a* may be provided in each of two second supporting members 75.

In the embodiment above, the first supporter 74*a* makes contact with the outer circumferential surface of the supporting shaft 71*a* on each of the both sides of the roller 71 in the front-rear direction (axial direction of the supporting shaft 71*a*) and the second supporter 75*a* makes contact with the outer circumferential surface of the supporting shaft 71*a* on each of the sides of the roller 71 in the front-rear direction. The disclosure, however, is not limited to this arrangement. The first supporter 74*a* may make contact with the outer circumferential surface of the supporting shaft 71*a* on at least one side of the roller 71 in the front-rear direction. The second supporter 75*a* may make contact with the outer circumferential surface of the supporting shaft 71*a* on at least the other side of the roller 71 in the front-rear direction. For example, the supporting shaft 71*a* may be clamped in such a way that the first supporter 74*a* makes contact with the outer circumferential surface of the supporting shaft 71*a* on the front side of the roller 71 whereas the second supporter 75*a* makes contact with the outer circumferential surface of the supporting shaft 71*a* on the rear side of the roller 71.

While in the embodiment above the second supporting member 75 is biased by the biasing member 76 provided between the second supporting member 75 and the holding unit 73, the disclosure is not limited to this arrangement. That is, for example, the second supporting member 75 may be supported by the base 60 to be swingable about an axis extending along the front-rear direction, and may be biased by a torsion coil spring provided between the second supporting member 75 and the base 60.

While the embodiment above describes a case where the notch 75*e* is formed at a part of the second supporter 75*a*, which opposes the outer circumferential surface of the supporting shaft 71*a*, the disclosure is not limited to this arrangement. Such a notch is required to be formed in only at least one of the first supporter 74*a* or the second supporter 75*a*. The notch may not be formed neither in the first supporter 74*a* nor in the second supporter 75*a*.

In the embodiment above, because the notch 75*e* is formed in the second supporter 75*a*, the second supporter 75*a* has two flat surfaces 75*e*1 and 75*e*2 opposing the outer circumferential surface of the supporting shaft 71*a*. The second supporter 75*a* makes contact with the outer circumferential surface of the supporting shaft 71*a* at the two flat surfaces 75*e*1 and 75*e*2. However, the shape of the notch 75*e* is not limited to this. That is, for example, three or more flat surfaces may be formed due to the formation of the notch 75*e*, and the second supporter 75*a* may make contact with the outer circumferential surface of the supporting shaft 71*a* at the three flat surfaces. Alternatively, a curved surface shaped along the outer circumferential surface of the supporting shaft 71*a* may be formed due to the formation of the notch 75*e*, and the second supporter 75*a* may make surface-contact with the outer circumferential surface of the supporting shaft 71*a*.

In the embodiment above, the connecting tool 78 is attached to the base 60 at one end portion and is attached to the supporting shaft 71*a* at the other end portion. In other words, the connecting tool 78 directly connects the supporting shaft 71*a* with the base 60. However, the disclosure is not limited to this. For example, one end portion of the connecting tool 78 may be attached to the pillar 72 or the holding unit 73 attached to the base 60. In other words, the connecting tool 78 may indirectly connect the supporting shaft 71*a* with the base 60 through the pillar 72 or the holding unit 73. Alternatively, the supporting shaft 71*a* may not be connected to the base 60 by the connecting tool 78.

The embodiment above describes when the guide rollers 61*b* and 61*h* are provided at positions where the yarn path is shortened when the roller is detached. In this regard, the guide rollers 61*b* and 61*h* may not be provided at the positions where the yarn path is shortened when the roller is detached.

The embodiment above has described that, when detecting by the sensor 79, 89 that the support of the supporting shaft by the guide roller 61*b*, 61*h* is canceled, the controller 5 stops the conveyance motor 59 to stop the conveyance of the fiber bundles F. This control by the controller 5, however, may not be performed.

In the embodiment above, when the guide roller 61*b* is detached from the yarn path guide mechanism 70, the yarn path between the guide roller 61*a* and the dancer roller 62 that are provided upstream downstream the guide roller 61*b* in the running direction of the fiber bundle F is short compared to when the guide roller 61*b* is supported by the yarn path guide mechanism 70. The disclosure, however, is not limited to this arrangement. That is, when the guide roller 61*b* is detached from the yarn path guide mechanism 70, the yarn path may not necessarily be short as compared to the case where the guide roller 61*b* is supported by the yarn path guide mechanism 70.

While the embodiment above describes the yarn path guide mechanism capable of guiding the fiber bundles running in the filament winding device, the disclosure is not limited to this arrangement. This disclosure can be applied to textile machines that handle fiber bundles and are different from the filament winding device.

What is claimed is:

1. A yarn path guide mechanism capable of guiding running fiber bundles, comprising:

a roller which allows the fiber bundles to be wound onto the roller;

a supporting shaft which supports the roller to be rotatable;

a first supporter which makes contact with an outer circumferential surface of the supporting shaft at least on one side of the roller in an axial direction of the supporting shaft;

a second supporter which is provided at a position where the supporting shaft is sandwiched between the second supporter and the first supporter and is able to make contact with the outer circumferential surface of the supporting shaft at least on the other side of the roller in the axial direction, the other side being opposite to the one side; and a biasing member which is configured to bias the second supporter in a direction in which the supporting shaft is sandwiched between the second supporter and the first supporter, the supporting shaft being supported in such a way that the supporting shaft is clamped between the first supporter and the second supporter, and when a virtual straight line which is orthogonal to the axial direction and passes through a winding center that is the center in a circumferential direction of the roller at a part where the fiber bundles are wound onto the roller and a rotation center of the supporting shaft is a first virtual straight line whereas the virtual straight line which extends in a direction orthogonal to both the axial direction and the first virtual straight line and passes through the rotation center is a second virtual straight line, the second supporter making contact with a part of the outer circumferential surface of the supporting shaft, which is positionally opposite to the winding center over the second virtual straight line.

2. The yarn path guide mechanism according to claim 1, wherein, in at least one of the first supporter or the second supporter, a notch is formed in a part opposing the outer circumference of the supporting shaft.

3. The yarn path guide mechanism according to claim 1, further comprising:

a base to which the first supporter and the second supporter are attached; and a connecting tool which directly or indirectly connects the supporting shaft with the base.

4. A textile machine comprising the yarn path guide mechanism of claim 1.

5. The textile machine according to claim 4, further comprising:

a sensor which is capable of detecting that support of the supporting shaft by the first supporter and the second supporter is canceled;

a conveyance mechanism which is configured to convey the fiber bundles at a location at least downstream of the yarn path guide mechanism in a running direction of the fiber bundles; and a controller, the controller stopping conveyance of the fiber bundles by the conveyance mechanism, when the sensor detects that the support of the supporting shaft is canceled.

6. The textile machine according to claim 4, further comprising:

a first guide member which is provided upstream of the yarn path guide mechanism in a running direction of the fiber bundles and is capable of guiding the running fiber bundles; and a second guide member which is provided downstream of the yarn path guide mechanism in the running direction of the fiber bundles and is capable of guiding the running fiber bundles, when the support of the supporting shaft by the first supporter and the second supporter is canceled, a yarn path between the first guide member and the second guide member being short as compared to a case where the support shaft is supported by the first supporter and the second supporter.

* * * * *